United States Patent [19]

Pierce

[11] 4,321,421

[45] Mar. 23, 1982

[54] VAPORIZATION COOLED TRANSFORMER HAVING A HIGH VOLTAGE

[75] Inventor: Linden W. Pierce, Rome, Ga.

[73] Assignee: General Electric Company

[21] Appl. No.: 18,135

[22] Filed: Mar. 7, 1979

[51] Int. Cl.[3] ..... H01F 27/18

[52] U.S. Cl. ..... 174/11 R; 174/15 R; 336/57; 361/37

[58] Field of Search ..... 165/30, 45, 105, DIG. 14; 174/14 R, 15 R, 11 R; 336/55, 57, 58, 60, 61; 361/35, 37

[56] References Cited

U.S. PATENT DOCUMENTS

| | | | |
|---|---|---|---|
| 1,591,163 | 7/1926 | Greenwood | 174/14 R |
| 2,759,987 | 8/1956 | Narbutovskih | 174/15 R |
| 2,990,443 | 6/1961 | Camilli | 336/57 X |
| 3,261,905 | 7/1966 | Allen | 174/15 R |
| 3,371,298 | 2/1968 | Narbut | 336/57 |
| 3,444,308 | 5/1969 | Narbut | 174/15 R |
| 3,626,080 | 12/1971 | Pierce | 174/15 R |
| 3,855,503 | 12/1974 | Ristuccia | 361/37 |
| 3,989,102 | 11/1976 | Jaster et al. | 174/15 R |
| 4,145,679 | 3/1979 | Mitchell | 336/57 |

*Primary Examiner*—A. D. Pellinen
*Attorney, Agent, or Firm*—Robert A. Cahill

[57] ABSTRACT

A vaporization cooled transformer utilizes the vaporized coolant at a constant predetermined pressure for upgrading the dielectric strength of the coolant. An auxiliary heater is employed for vaporizing the coolant at low temperature ambient conditions. The constant predetermined pressure is maintained at higher ambient conditions by controlling the cooling capacity of a plurality of heat exchangers.

6 Claims, 7 Drawing Figures

VAPORIZATION COOLED TRANSFORMER HAVING A HIGH VOLTAGE

BACKGROUND OF THE INVENTION

U.S. patent application Ser. No. 843,676 filed Oct. 19, 1977, discloses a vaporization cooled transformer design for transformers rated at 3750 kVA and having a basic insulation level (BIL) of 95 kV. The coolant employed within the described vaporization cooled transformer comprises a chlorinated fluorocarbon having a dielectric strength in its liquid state approximately equivalent to transformer mineral oil. When the transformer is operated at rated loading, the vaporized coolant exhibits a sufficiently high pressure to prevent dielectric breakdown from occurring within the winding and between the winding and the transformer wall. When the transformer is operated under conditions of low ambient temperatures, the pressure exhibited by the vaporized coolant is not sufficient to provide the necessary dielectric strength. In order to prevent breakdown from occurring at low ambient conditions, a large amount of solid insulation must be employed around the winding and the spacing between the internal electrical conductors must be large enough to ensure that breakdown does not occur.

When basic insulation levels higher than 95 kV are desired the added insulation material required to compensate for the decreased dielectric strength occurring at low coolant pressures makes the overall transformer size economically infeasible. The larger transformer tank needed to provide the necessary separation distances between the windings and the tank wall, requires a larger quantity of liquid coolant within the tank. The design of a vaporization cooled transformer for operating at higher ratings than 3750 kVA requires a large heat exchanger to cool the coolant in order to prevent the transformer core and windings from becoming overheated at the higher operating temperatures. Since the cooling facility of the heat exchanger depends upon the surface area exposed to the ambient air, a larger number of condenser tubes and auxiliary cooling fans must be employed.

The purpose of this invention is to provide a vaporization cooled transformer having increased voltage ratings without requiring a substantial increase in the overall size of the transformer tank and the heat exchanger.

SUMMARY OF THE INVENTION

A vaporization cooled transformer provides cooling and heating facility to the transformer to operate the condensable coolant at a predetermined pressure over a wide range of ambient temperatures. The predetermined pressure provides a dielectric strength to the coolant equivalent to transformer mineral oil. One embodiment provides a microprocessor in combination with a series of heat exchangers and an auxiliary heater to control the rates of heating and cooling. The microprocessor is programmed to control the number of heat exchangers required and the operating cycle of the auxiliary heater to adjust the coolant vapor pressure under varying climatic conditions.

DESCRIPTION OF THE PREFERRED EMBODIMENT

Figure 1:
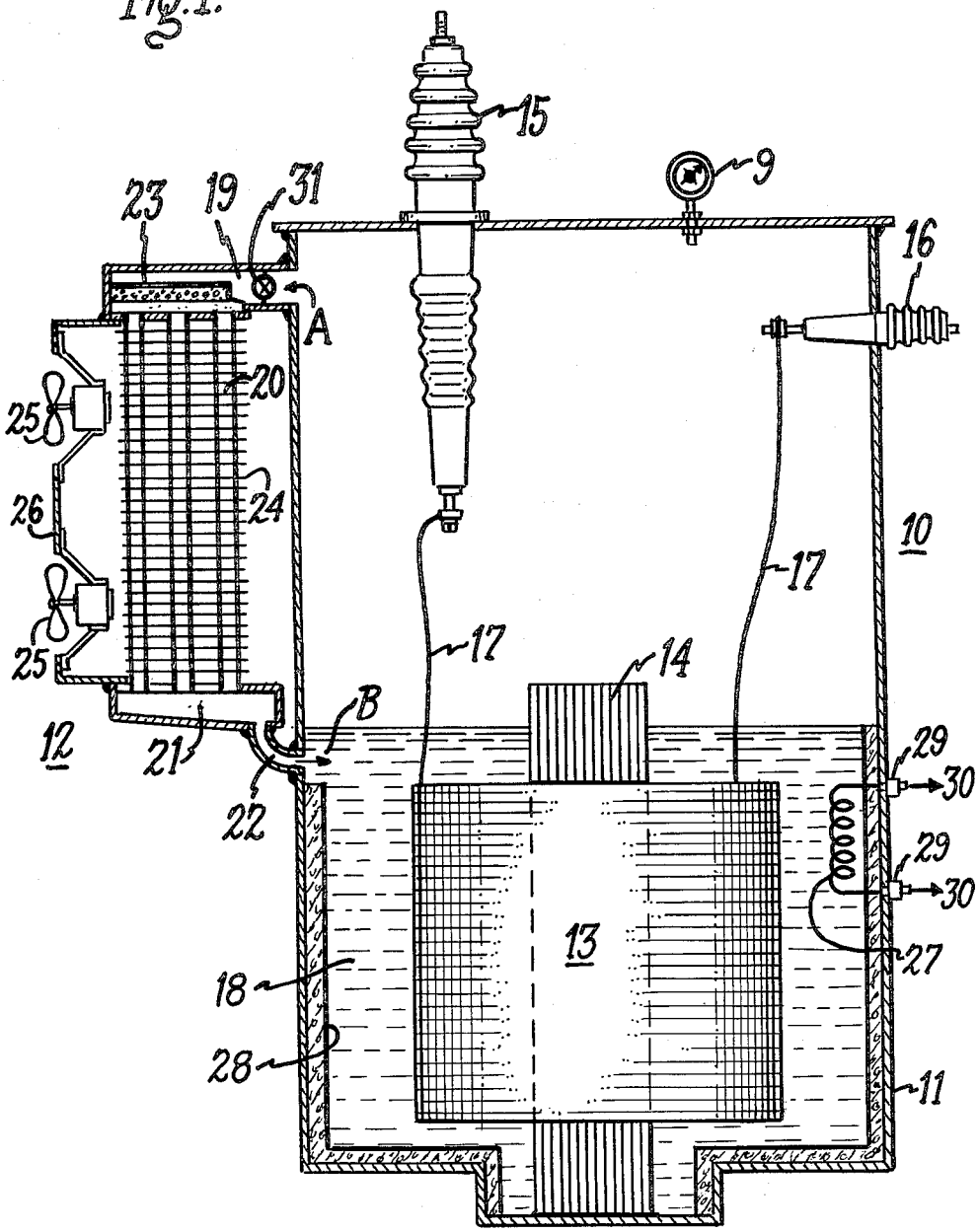
FIG. 1 is a side sectional view of the vaporization cooled transformer according to the invention.

FIG. 1 shows a vaporization cooled transformer 10 similar in operation to that described within the aforementioned U.S. patent application and containing a transformer tank 11 in combination with a heat exchanger 12 for cooling and electrically insulating winding 13 and core 14 within the tank. High voltage bushing 15 situated at the top of the tank and low voltage bushing 16 on the side of the tank wall provide electrical connection with the winding by means of cables 17. The tank contains a quantity of coolant 18 which is a chlorinated fluorocarbon such as trichlorotrifluoroethane which when heated vaporizes and enters intake manifold 19 in the direction indicated by Arrow A. The vaporized coolant then enters a plurality of cooling tubes 20 wherein the coolant condenses and returns through the exit manifold 21 and return pipe 22 back to the transformer tank. A quantity of molecular sieve material 23 is located within the intake manifold for removing any moisture released by the cellulosic insulation materials in the winding during transformer operation. The cooling tubes also contain a plurality of fins 24 to increase the effective cooling area of the tubes when used in combination with one or more fans 25 connected together by means of shroud 26. An auxiliary heater 27 is employed in combination with a layer of gas filled foam insulation material 28 on the inner surface of the tank to heat the coolant and keep the coolant at a sufficiently high temperature in cold weather operation. The insulating foam can also be arranged on the outside of the tank but is situated internal to the tank in this embodiment for the purpose of displacing some of the expensive coolant as a cost savings feature.

Figure 2:
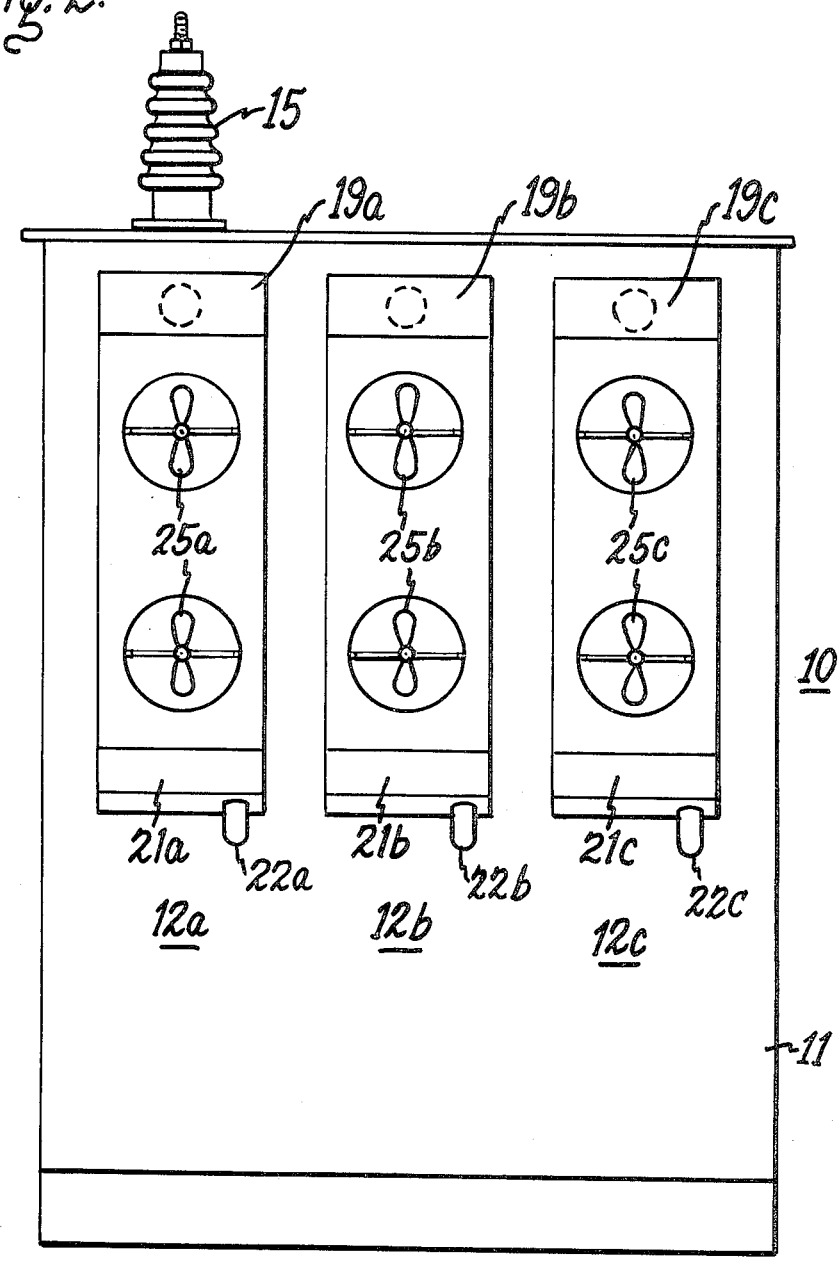
FIG. 2 is a front view of the transformer of FIG. 1.

FIG. 2 is a front view of the transformer 10 depicted in FIG. 1 wherein like reference numbers are used to designate corresponding elements such as tank 11 and bushing 15. Three heat exchangers 12*a*, 12*b*, and 12*c* are arranged along the wall of the tank and each heat exchanger contains a pair of fans 25*a*, 25*b*, and 25*c*. The heat exchangers are connected to the tank by means of intake manifolds 19*a*, 19*b* and 19*c* located at the top of the heat exchangers and return pipes 22*a*, 22*b*, and 22*c* which connect with exit manifolds 21*a*, 21*b*, and 21*c* located at the bottom of the heat exchangers. The requirement of more than one heat exchanger and more than one fan within each heat exchanger will be discussed in detail below.

The operation of a vaporization cooled transformer with a single large heat exchanger revealed that the vapor pressure of the coolant above the liquid in the transformer tank was a sensitive function of the transformer loading as well as the ambient air temperature in the vicinity of the heat exchanger. The vapor pressure of the coolant for purposes of this disclosure means the pressure exerted by the vaporized coolant in equilibrium with the liquid coolant at a given temperature. The equilibrium pressure will also be referred to as the "saturation pressure" since a change in the temperature of the liquid coolant immediately causes a corresponding increase in the vapor pressure exerted by the vaporized coolant.

Figure 3:
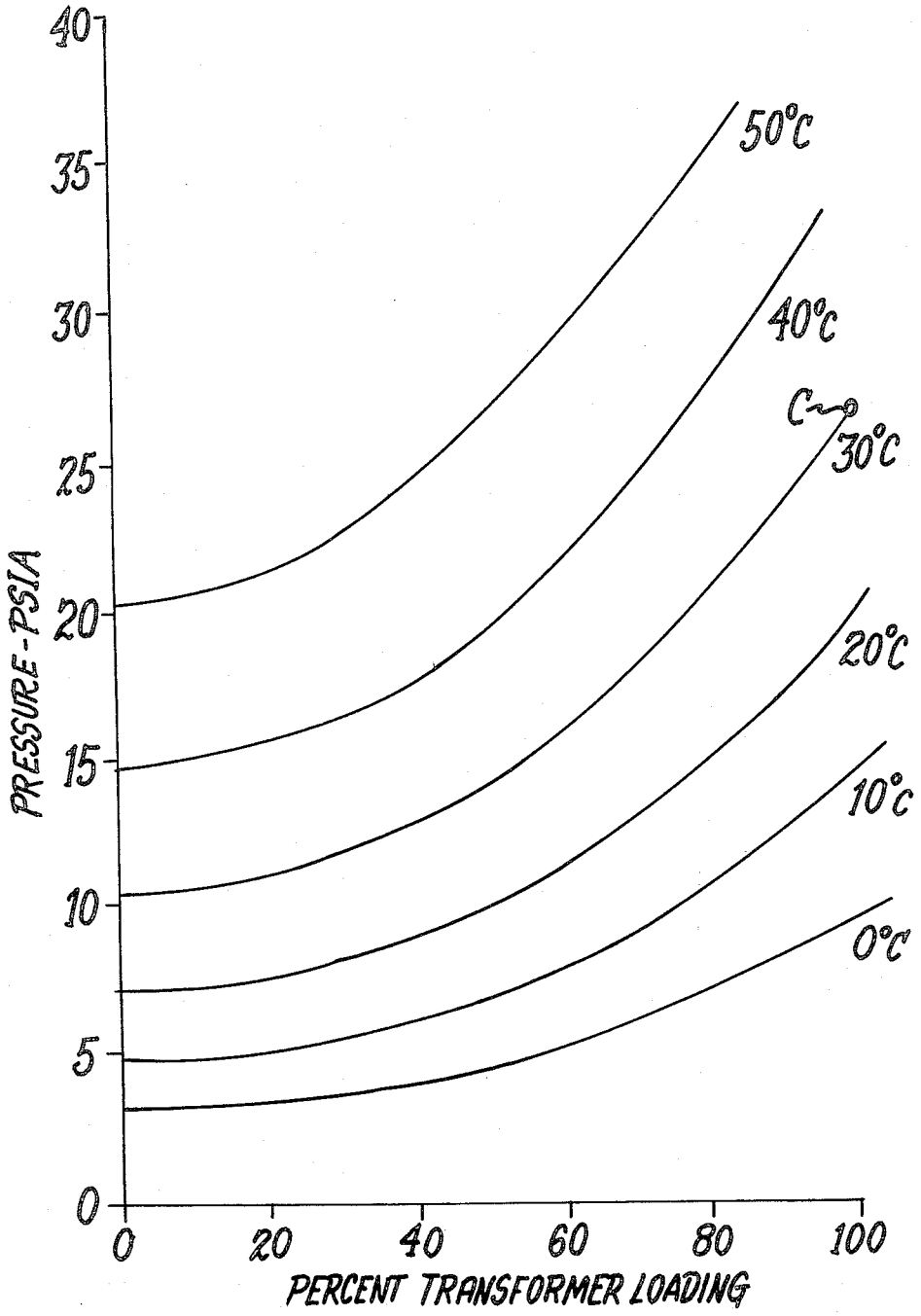
FIG. 3 is a graphic representation of the coolant vapor pressure of a vaporization cooled transformer as a function of transformer loading for contours of ambient air temperatures.

FIG. 3, which shows the coolant vapor pressure as a function of loading and ambient temperature, indicates that the vapor pressure of the coolant increases with transformer loading due to the heat generated within the transformer core and the winding and that the limit in the pressure is governed by the ambient temperature conditions for a given heat exchanger design. It can be seen from comparing the steady state vapor pressure with the transformer operating at 100 percent loading in an ambient temperature of 10° C. to that in an ambient of 50° C. that the vapor pressure is nearly doubled at the higher ambient temperature.

The operating design point for 30° C. ambient operating conditions indicated at C results in a coolant vapor pressure of approximately 27 pounds per square inch absolute (PSIA). Since the coolant vapor pressure for a vaporization cooled transformer varies from less than 5 PSIA at startup to approximately 27 PSIA at 100 percent loading the effect of the low- and high-coolant vapor pressure upon the dielectric properties of the vaporized coolant were investigated in order to determine whether more insulation should be applied to the winding to protect the winding from arc-over at low ambient temperatures during startup when the transformer rating is disclosed.

Figure 4:
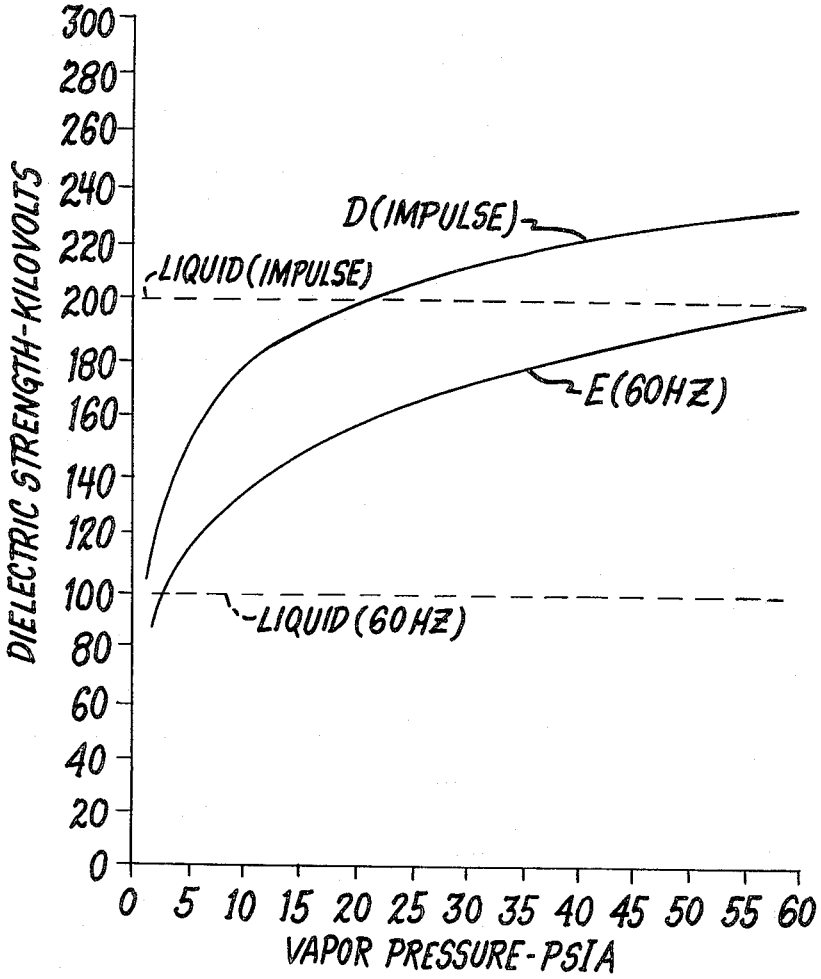
FIG. 4 is a graphic representation of the dielectric strength of the coolant vapor as a function of coolant vapor pressure.

FIG. 4 shows the dielectric strength in kilovolts as measured between a ¼" diameter rounded electrode and a flat plate with a 3" separation distance between the electrode and the plate, tested for impulse and 60 Hertz breakdown conditions in an atmosphere of saturated coolant vapor. The impulse voltage dielectric strength D is approximately 200 kV when the coolant vapor pressure exceeds 20 PSIA. The 60 Hertz dielectric strength E for the same coolant vapor pressure is approximately 160 kilovolts. Since the dielectric strength in kilovolts for the vaporized coolant at 20 PSIA is approximately equivalent to the dielectric strength for transformer mineral oil it was then first realized that maintaining the coolant vapor pressure above 20 PSIA would result in a vaporization cooled transformer having the same electrical properties as a mineral oil cooled transformer at equivalent ratings. Since the dielectric constant of trichlorotrifluoroethane as a liquid is approximately equal to the dielectric constant of standard transformer mineral oil, it was expected that the dielectric strength properties would only be equivalent while the coolant remained in its liquid phase. The dielectric strength of the liquid coolant at 21.5° C. for both impulse and 60 Hz voltages are included in FIG. 4 for comparison purposes. A serious dielectric problem was anticipated when the coolant vaporized during its vapor transport cycle and the winding has to rely in part upon the dielectric properties of the coolant vapor. It was heretofore anticipated that the dielectric strength of the vaporized coolant would be no greater than air. FIG. 4 shows, however, that maintaining the coolant vapor pressure at or in excess of 20 PSIA results in a dielectric strength approximately equivalent to that of the liquid coolant at 21.5° C.

Figure 5:
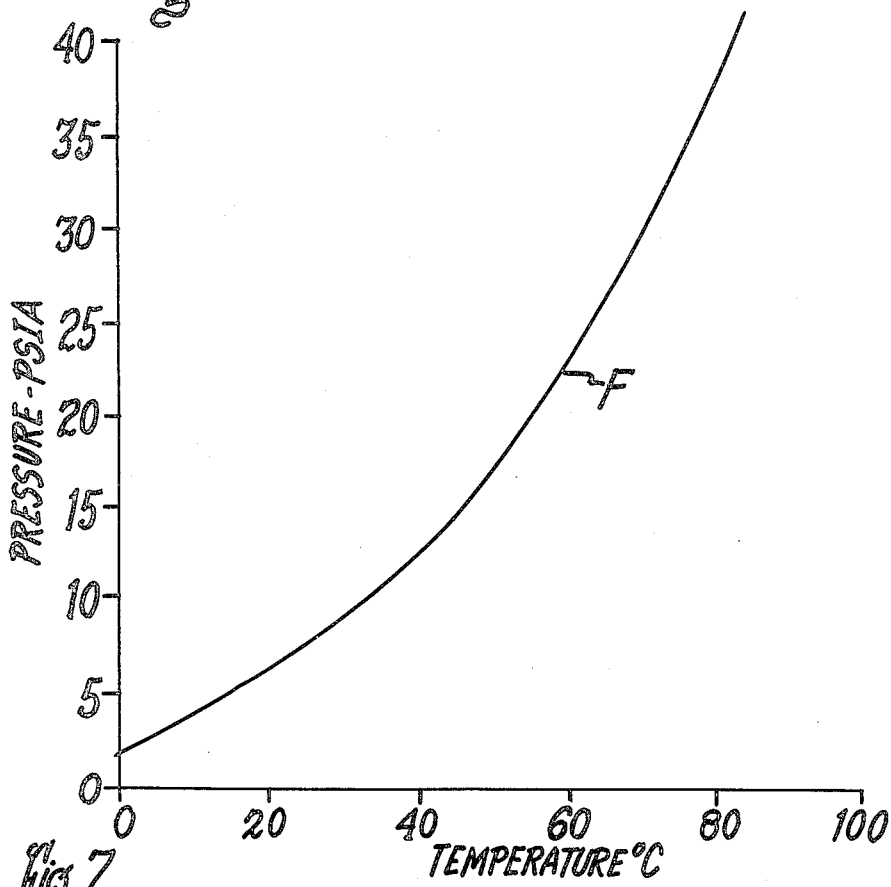
FIG. 5 is a graphic representation of the vapor pressure of the liquid coolant as a function of coolant temperature.

The vapor pressure of trichlorotrifluoroethane coolant as a function of temperature is shown at F in FIG. 5. In order to maintain a vapor pressure equal to or greater than 20 PSIA the temperature of the coolant must be maintained in excess of approximately 57° C. Since temperatures less than 50° C., for example, would result in a coolant vapor pressure having reduced dielectric strength, and temperatures greater than 100° C. would result in coolant vapor pressures in excess of the strength properties of the heat exchanger assembly, some means must be employed for keeping the coolant temperature within the 50° to 100° C. range. As shown earlier in FIG. 3, a design point of 25 PSIA could be employed and the pressure could vary from 20 to 30 PSIA in an ambient temperature range of 30° to 40° C.

The vaporization-cooled transformer described in the aforementioned U.S. patent application utilizes a large heat exchanger for the purpose of insuring that the vapor pressure of the coolant remained within reasonable values over wide ranges of ambient temperature. The heat exchangers of the instant invention depicted in FIGS. 1 and 2 are substantially smaller than the aforementioned heat exchanger in total surface area exposed and are operated sequentially in a controlled manner for closely regulating the coolant temperature. Auxiliary heater 27 connected to the side of the tranformer tank by means of feed throughs 29 and electrically connected with a voltage source by means of electrical conductors 30, is used to heat the liquid coolant within the tank up to 50° C. before the transformer is energized. This assures that the vapor pressure of the vaporized coolant above the liquid is in excess of 20 PSIA and that the dielectric strength of the vaporized coolant is sufficient for protecting the internal components of the transformer. When the transformer becomes fully energized the heater is shut off and at least one of the heat exchangers becomes operatively connected with the tank by means of solenoid valve 31 for example. The first heat exchanger **12*a* of FIG. 2 could be connected to the tank by means of an electrically operated solenoid valve within intake manifold 19*a* or by means of a pressure actuated valve designed to operate when the coolant vapor pressure exceeds the design operating pressure of 25 PSIA. With the first heat exchanger 12*a* in operation and with the transformer at rated power, fans 25*a* would become actuated in the event that the ambient conditions were such that the cooling tubes alone were incapable of reducing the coolant temperature and the resulting vapor pressure increased above the 30 PSIA upper limit. Either one or both fans 25*a* could become activated depending upon the amount of cooling required. When ambient temperatures are high, the first heat exchanger is insufficient to cool the vaporized coolant and to cause the coolant vapor pressure to remain within the 30 PSIA upper limit. A second solenoid valve or pressure-actuated valve could become actuated connecting second heat exchanger 12*b* and allowing the vaporized coolant to enter by means of second intake manifold 19*b* and return to the tank by means of second exit manifold 21*b*** and second return pipe 22*b*. Fans **25*b* are employed within the second manifold to provide added cooling facility as described earlier for the first manifold. Third heat exchanger 12*c*** is provided in the event that the ambient temperature conditions are such that further cooling is required. It is to be understood that a single heat exchanger having a plurality of fans located along the extent of the cooling tubes could be employed and that the fans could be connected to a control system for automatically starting and stopping the fans depending upon the degree of cooling or heating required. When more than one heat exchanger is employed the heat exchangers can be operatively connected with the tank in a parallel arrangement, or the heat exchangers can be serially connected with each other depending upon the particular transformer design. The heat exchangers can also be directly connected to the tank without valves. In this case merely turning on the fans would increase the cooling within each separate heat exchanger.

Figure 6:
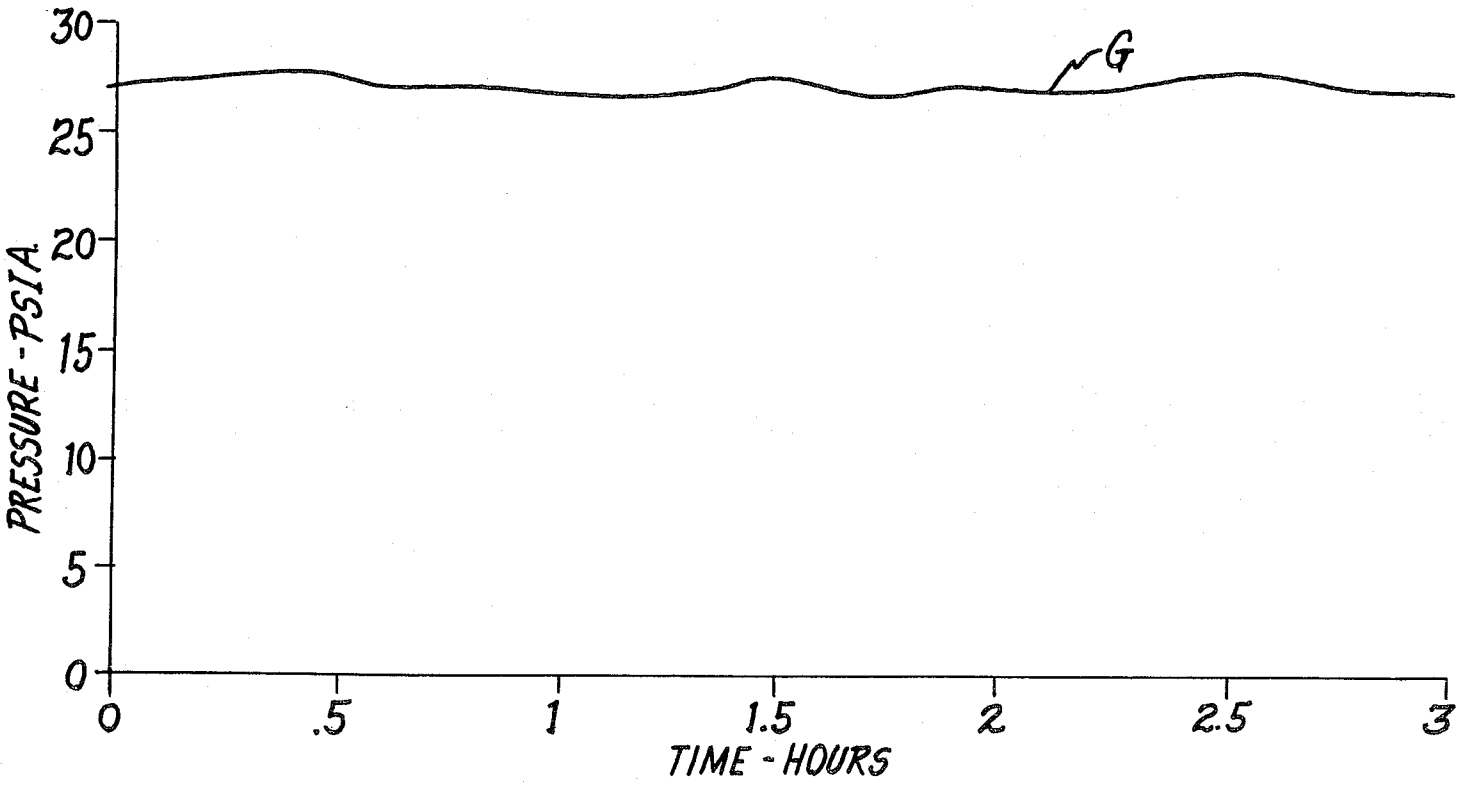
FIG. 6 is a graphic representation of the relation between the vapor pressure and time for the vaporization cooled transformer of the invention.

Operating a 200 kVA transformer from 0 to 100% rating over an ambient temperature range of from 17° to 23° C. resulted in the relatively constant vapor pressure G shown in FIG. 6. The load was increased in 33% increments over a 3 hour period and the fans (FIGS. 1 and 2) were cycled on and off to keep the pressure at the 27 to 28 PSIA design point. The number of fans to be operated in accordance with transformer load and ambient temperature can be determined and a program designed for each transfomer rating. A smaller number of fans can be employed and the operating cycle of the fans can be programmed to switch on and off as an alternative to the sequential use of a larger number of fans. For the constant vapor pressure G of FIG. 6 a direct reading pressure gage 9 was included in the transformer tank, as shown in FIG. 1, and the heater and fans were manually switched to maintain the pressure at a constant value as the transformer loading and ambient varied. For long term operation, a pressure control device can be employed to sense the pressure and automatically switch on the fans and the heater as required.

Although pressure-sensing mechanisms are employed it is to be well understood that temperature-sensing mechanisms such as thermocouples, thermistors, and direct reading thermometers can also be employed to determine the coolant vapor pressure. This can be seen by the relationship indicated between coolant vapor pressure and temperature shown earlier in FIG. 5. This is true as long as there remains some coolant in liquid form and the vapor exhibits a vapor pressure and does not behave as an ideal gas. When temperature-sensing devices are employed within the transformer tank or heat exchanger the fans and the heater can be operatively connected in a manner similar to that for the pressure sensing embodiment. Temperature sensors can be used for determining the ambient temperature condition and electrical meters can be connected within the transformer control circuitry to determine the transformer load. These parameters in combination with the coolant vapor temperature or pressure are sufficient to control the operating coolant vapor pressures within the transformer tank over the full operating range of the transformer over a wide range of ambient temperatures.

Figure 7:
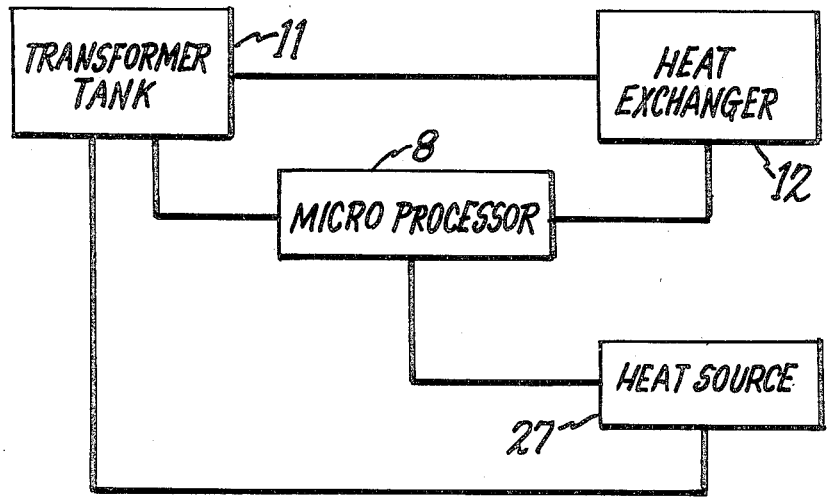
FIG. 7 is a schematic diagram showing the interconnection between the elements of FIGS. 1 and 2 implemented by means of a microprocessor.

FIG. 7 shows one arrangement for operatively connecting heat exchanger 12 and heat source 27 to transformer tank 11. This arrangement employs a microprocessor 8 electrically connected to the transformer tank for sensing the temperature of the liquid coolant or the vapor pressure of the vaporized coolant and, in turn, activating either the heat exchanger or the heat source depending upon whether the coolant temperature and vapor pressure are too high or too low, respectively. Alternatively, the transformer can be directly connected with the heat exchanger wherein a temperature or pressure sensor within the transformer tank directly actuates the heat exchanger valves or the fan controls without the microprocessor control unit 8. The heat source can also be electrically connected with a temperature or pressure sensor within the transformer tank for directly causing the heat source to become energized upon sensing low coolant temperatures and coolant vapor pressures and de-energized when the coolant temperature and vapor pressure reach a predetermined amount. The microprocessor can be programmed to sense an electrical output signal of a particular magnitude which is generated by a thermocouple pressure gauge or a thermistor temperature-sensing device within the tank to provide output control facility to both the heat exchanger and the heat source.

It is to be well understood that the properties of the vaporizable coolant employed determine the corresponding coolant vapor pressure and electric strength so that the operating range of coolant temperatures and coolant vapor pressures may vary when different coolants are employed. The microprocessor would have to be individually programmed for operating with a prescribed coolant. The nature and design of the heat exchangers and the heat source as well as the transformer operating characteristics would have to be carefully determined for each microprocessor program.

Although the controlled pressure arrangement of the invention is described for operation with a transformer, this is by way of example only. The controlled coolant vapor pressure arrangement of the invention finds application wherever any electrical device requiring both cooling and electrical insulation is to be employed.

What I claim as new and desire to secure by Letters Patent of the United States:

1. Vaporization cooled transformer comprising:

a transformer tank containing a dielectric coolant consisting of a single fluid in liquid and vapor forms for cooling and insulating a core and winding assembly within said tank;

a heat exchanger communicating with said tank interior for receiving the dielectric coolant in vapor form and condensing the dielectric coolant for return to said tank in liquid form;

means monitoring the vapor pressure of the dielectric coolant within said tank; and means repsonsive to said monitoring means for controlling the rate of condensation of the dielectric coolant vapor within said heat exchanger in a manner to maintain the dielectric coolant vapor pressure in said tank within a predetermined range in order to insure adequate dielectric strength of the dielectric coolant vapor.

2. The vaporization cooled transformer of claim 1 wherein said monitoring means includes a pressure sensing device situated within said tank.

3. The vaporization cooled transformer of claims 1 or 2 which further comprises a heater for heating the dielectric coolant in its liquid form pursuant to increasing the vapor pressure thereof.

4. The vaporization cooled transformer of claims 1 or 2, wherein said responsive means includes valve means for controlling the flow of dielectric coolant vapor into said heat exchanger.

5. The vaporization cooled transformer of claims 1 or 2, wherein said responsive means includes at least one controllably operated fan associated with said heat exchanger.

6. The vaporization cooled transformer of claim 5 wherein said responsive means further includes valve means controlling the flow of dielectric coolant vapor into said heat exchanger.

* * * * *